US007102091B2

(12) United States Patent
Miyata et al.

(10) Patent No.: US 7,102,091 B2
(45) Date of Patent: Sep. 5, 2006

(54) LEVER SWITCH

(75) Inventors: Muneyoshi Miyata, Tokyo (JP); Satoshi Myoujin, Tokyo (JP); Shinichi Tadano, Tokyo (JP)

(73) Assignee: MIK Electronic Corporation, Tokyo (JP)

( * ) Notice: Subject to any disclaimer, the term of this patent is extended or adjusted under 35 U.S.C. 154(b) by 0 days.

(21) Appl. No.: 11/291,158

(22) Filed: Dec. 1, 2005

(65) Prior Publication Data

US 2006/0118398 A1 Jun. 8, 2006

(30) Foreign Application Priority Data

Dec. 3, 2004 (JP) ..... 2004-351065

(51) Int. Cl.
*H01H 13/06* (2006.01)

(52) U.S. Cl. ..... 200/302.2; 200/6 R; 200/553; 200/570; 200/332

(58) Field of Classification Search ..... 200/302.2, 200/6 R, 11 TW, 293, 296, 297, 564, 565, 200/553, 570, 252, 302.1, 332, 302.3, 335, 200/339

See application file for complete search history.

(56) References Cited

U.S. PATENT DOCUMENTS 3,809,833 A * 5/1974 Miller et al. ..... 200/61.27
5,939,690 A * 8/1999 Yasui et al. ..... 200/302.2
6,664,491 B1 * 12/2003 Yanai et al. ..... 200/516
6,897,386 B1 * 5/2005 Nakazawa et al. ..... 200/61.88

FOREIGN PATENT DOCUMENTS

JP 2000-331567 11/2000

* cited by examiner

*Primary Examiner*—Elvin Enad
*Assistant Examiner*—Lheiren Mae A. Anglo
(74) *Attorney, Agent, or Firm*—Norris McLaughlin & Marcus PA

(57) ABSTRACT

It is an object of the present invention to provide a lever switch capable of reliably preventing intrusion of water or the like into a casing and maintaining smooth operation of a switch mechanism for a long period of time. A lever switch provided with a switch mechanism whereby an operation lever rotates from a neutral position on a base against a spring force of a coil spring to change the position of the switch, a gap between the operation lever and base is filled with a casing, the switch mechanism is accommodated in the casing and a waterproof/dustproof mechanism is provided to seal a sliding surface between the operation lever and casing and a contact surface between the base and casing with an upper lip packing and lower lip packing respectively.

5 Claims, 16 Drawing Sheets

(a)

(b)

(a)

(a)

(b)

(a)

(b)

(a)

(b)

(a)

(b)

(a)

(b)

(a)

(b)

LEVER SWITCH

BACKGROUND OF THE INVENTION

1. Field of the Invention

The present invention relates to a lever switch required to have water proofing property and dust proofing property in an operating environment in particular such as a switch for detecting an opening/closed state of a power window of a vehicle.

2. Description of the Related Art

Japanese Patent Laid-Open No. 2000-331567 which discloses a waterproof lever switch has been applied by the applicant of the present invention.

This conventional switch has a structure in which a movable contact spring strip is disposed below a disk, from the perimeter of which a lever protrudes and a fixed contact is disposed below this movable contact spring strip. When an external force acts on the lever, a protrusion on the underside of the disk which rotates against a spring force presses the movable contact spring strip, the movable contact spring strip deflects and contacts the fixed contact to thereby turn on the switch. On the other hand, when the external force is released, the lever is restored to a neutral position through an elastic force of the spring, the movable contact spring strip separates from the fixed contact to thereby turn off the switch. A waterproof ring is inserted into a groove between the disk and a recess to provide waterproofing property.

In the conventional switch, the spring which biases the lever to the neutral position is disposed outside the disk and exposed without being covered. For this reason, this exposed spring may rust due to contact with water or the gap of the spring may be clogged with dust. This causes the spring to lose its elasticity, makes it difficult to restore the lever to the neutral position or the like, thus interfering with the operation of the lever and preventing the switch from functioning smoothly.

The present invention has been implemented in view of the above described problem and it is an object of the present invention to provide a lever switch which is perfectly and reliably preventable from water-intrusion or dust-intrusion through the casing of the switch, keeping smooth operation of a switch mechanism for a long period of time.

SUMMARY OF THE INVENTION

In order to attain the above described object, the lever switch according to the present invention comprises a base having a circular recess on a top surface thereof, a common fixed contact fixed to an interior of the circular recess, a pair of side fixed contacts fixed at symmetric positions inside the circular recess separated from each other, an operation lever consisting of a disk, a lever laterally protruding from the disk and a shaft protruding downward from the center of the disk, the shaft being rotatably supported to a boss which vertically protrudes from the center of the circular recess, a rotor fixed to the shaft of the operation lever and provided with a fan notch notched in a fan shape in the outer wall thereof at a predetermined angle, a common contact spring strip fixed to an underside of the rotor and having contact with the common fixed contact, a side contact spring strip fixed to an underside of the rotor and having contact with or separate from the side fixed contact, a double-structure casing fixed to the base and holding the rotor therein and consisting of an inner cylinder and an outer case, the inner cylinder surrounding the rotor and the outer case having a fan notch notched in a fan shape on the outer wall thereof at the same angle as the fan notch of the rotor, a coil spring wound around a perimeter of the inner cylinder, hooked at and fixed to both the fan notch, one tip bent part thereof pressing to one notch end of the rotor fan notch and one notch end of the casing fan notch, the other tip bent part to the others, to bias the operation lever to a neutral position on the base, an upper lip packing provided on a top surface of the casing in a ring shape and pressed against an underside of the disk, and a lower lip packing provided on an underside of the outer case in a ring shape and pressed against a perimeter of the circular recess.

In this lever switch, when an external force acts on the lever and the operation lever with the rotor is rotated from a neutral position of the base in a left or right direction against a spring force of the coil spring, the side contact spring strip of the movable contact which is fixed to the bottom surface of the rotor contacts comes into contact with one of the left or right side fixed contacts on the base and the switch is turned on. When the external force acting on the lever is released, the operation lever is restored to the neutral position by the elastic force of the coil spring, separating the side contact spring strip from the side fixed contact and the switch is turned off.

The gap between the base and operation lever is filled with the casing and the switch mechanism is accommodated in the casing, the sliding surface between the operation lever and casing being perfectly sealed by the upper lip packing of the casing and the contact surface between the base and casing is also being perfectly sealed by the lower lip packing of the casing.

For the lever switch having the above described construction, the following various preferred modes may be considered as the present invention. For example, it is preferable to further comprise barriers surrounding the circular recess on a side of the base, wherein the casing is accommodated inside the barriers.

Furthermore, it is also preferable to further comprise, in the base, a ring pedestal around a perimeter of the circular recess and mounts outside the ring pedestal, the ring pedestal having the same diameter as that of the lower lip packing and the mounts mounting and fixing the casing at the bottom of the outer case.

Furthermore, in addition to the above described construction, it is also preferable to comprise a cover for covering a common fixed terminal, a pair of side fixed terminals and lead wires, the common fixed terminal being connected to the common fixed contact, the pair of side fixed terminals being connected to the side fixed contacts, the common and side terminals protruding outward from the base, and lead wires being welded respectively to the common fixed terminal and the side fixed terminals.

The casing, upper lip packing and lower lip packing are preferably formed in a single piece made of elastomer. An example thereof may be thermoplastic polyester elastomer. The cross-sectional shape of the upper lip packing and lower lip packing is not particularly limited but L-, U- or V-figured sectional shape may be applicable.

The lever switch according to the present invention has the following operations and effects.

(1) Adopting the structure, in which the gap between the base and operation lever is filled with the casing, the switch mechanism is accommodated inside the casing and the sliding surface between the operation lever and casing and contact surface between the base and casing are both sealed by the lip packing, makes prevention against penetration of water, dust or the like from the outside of the casing into the switch mechanism, to keep smooth operation of the switch mechanism for a long period of time. Especially adopting a small diameter for the upper lip packing reduces the sliding friction resistance between the disk and upper lip packing in the rotation of the operation lever and requires only small operational force of the operation lever, giving smoother operation of the switch mechanism.

(2) Accommodation of the casing inside the barriers of the base avoids outside exposure of the sealed surface of the lower lip packing, so that the barriers prevent intrusion of water, dust or the like to the sealed surface of the lower lip packing, preventing the metal parts from rusting and the spring from clogging. The rusting and clogging would cause operational faults of the switch mechanism from occurring.

(3) Including the ring pedestal having the same diameter as that of the lower lip packing around the perimeter of the circular recess and providing mounts for mounting the bottom of the outer case outside the ring pedestal, make the joint surface between the outer case and base arranged outside the lower lip packing which seals the sealed surface. This double structure of the sealed surface and joint surface further improves waterproof and dustproof of the switch.

(4) The provision of the cover, which covers the common fixed terminal exposed outside the base, side fixed terminal and lead wires welded to both fixed terminals, completely shuts out the fixed terminals made of metal plates from the outside, reliably preventing trouble such as rusting and further improving durability of the switch.

DETAILED DESCRIPTION OF THE PREFERRED EMBODIMENTS

With reference now to the attached drawings, preferred embodiments of the present invention will be explained below.

Figure 1:
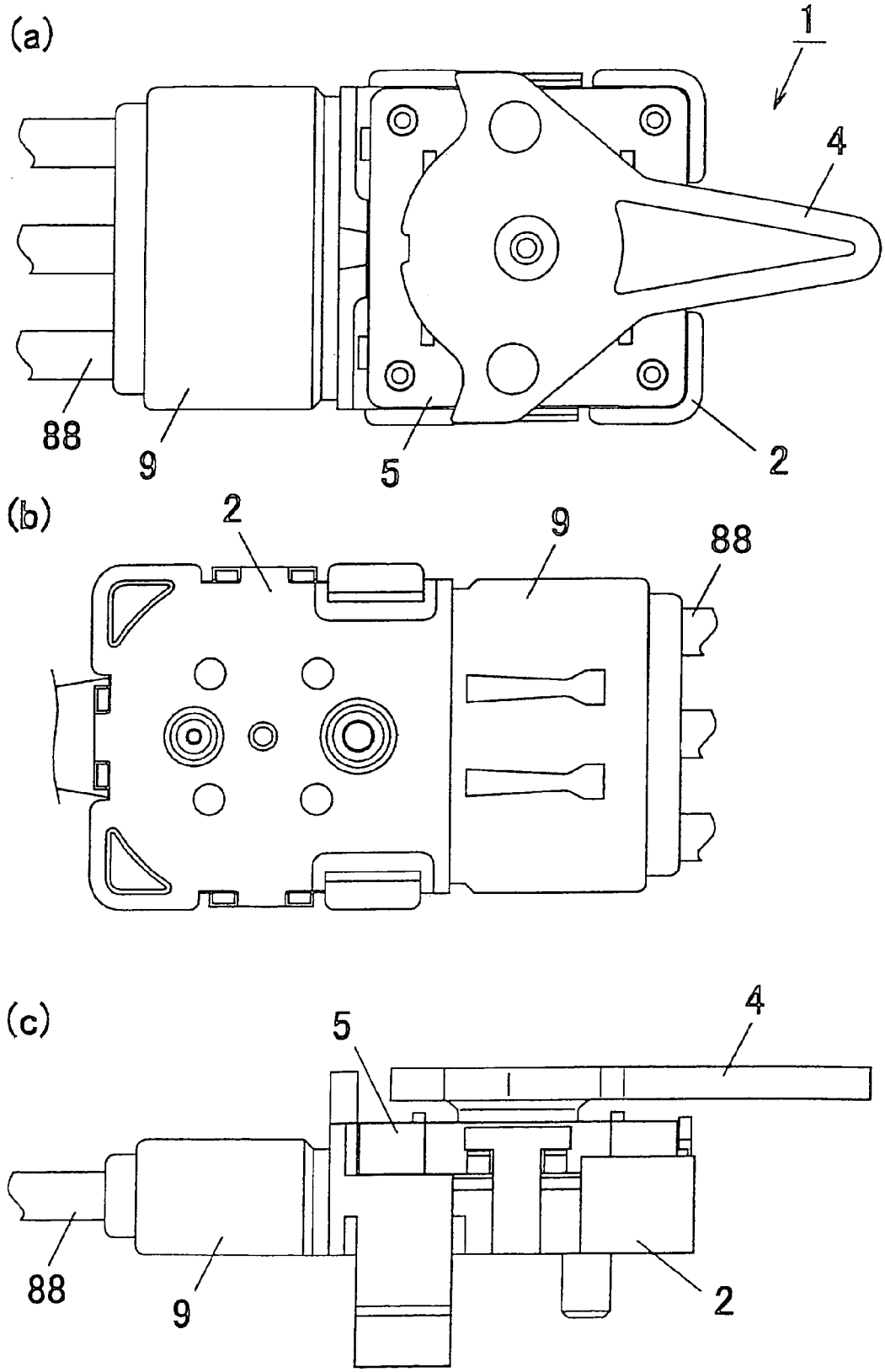
FIG. 1 shows a lever switch; (a) is a top view, (b) is a bottom view and (c) is a front view.
Figure 2:
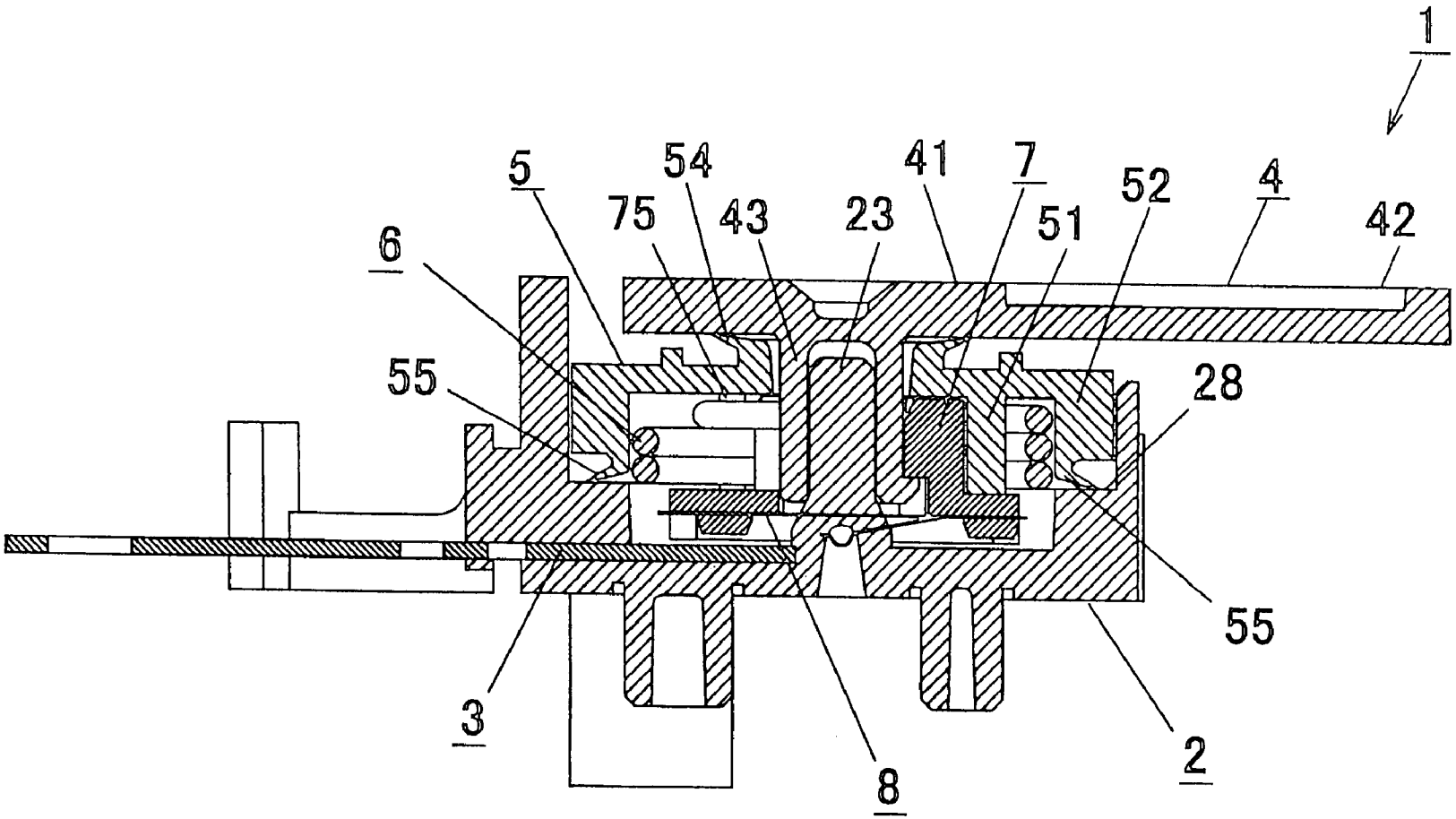
FIG. 2 is a cross-sectional view of the lever switch shown in FIG. 1.

FIG. 1 shows an appearance of a lever switch of this embodiment and FIG. 2 is a cross-sectional view of the switch. The lever switch 1 shown in FIG. 1 and FIG. 2 is constructed of components such as a base 2, fixed contact 3, operation lever 4, casing 5, coil spring 6, rotor 7 and movable contact 8.

The switch 1 is provided with a switch mechanism for switching between contacts with the fixed contact 3 and movable contact 8 by the operation lever 4 rotating on the base 2 and a waterproof/dustproof mechanism which fills the gap between the operation lever 4 and base 2 with the casing 5 to prevent foreign matters such as water and dust from intruding into the switch mechanism. Hereinafter, the detailed structure of this switch mechanism and waterproof/dustproof mechanism will be explained in accordance with a procedure for assembling components.

Figure 3:
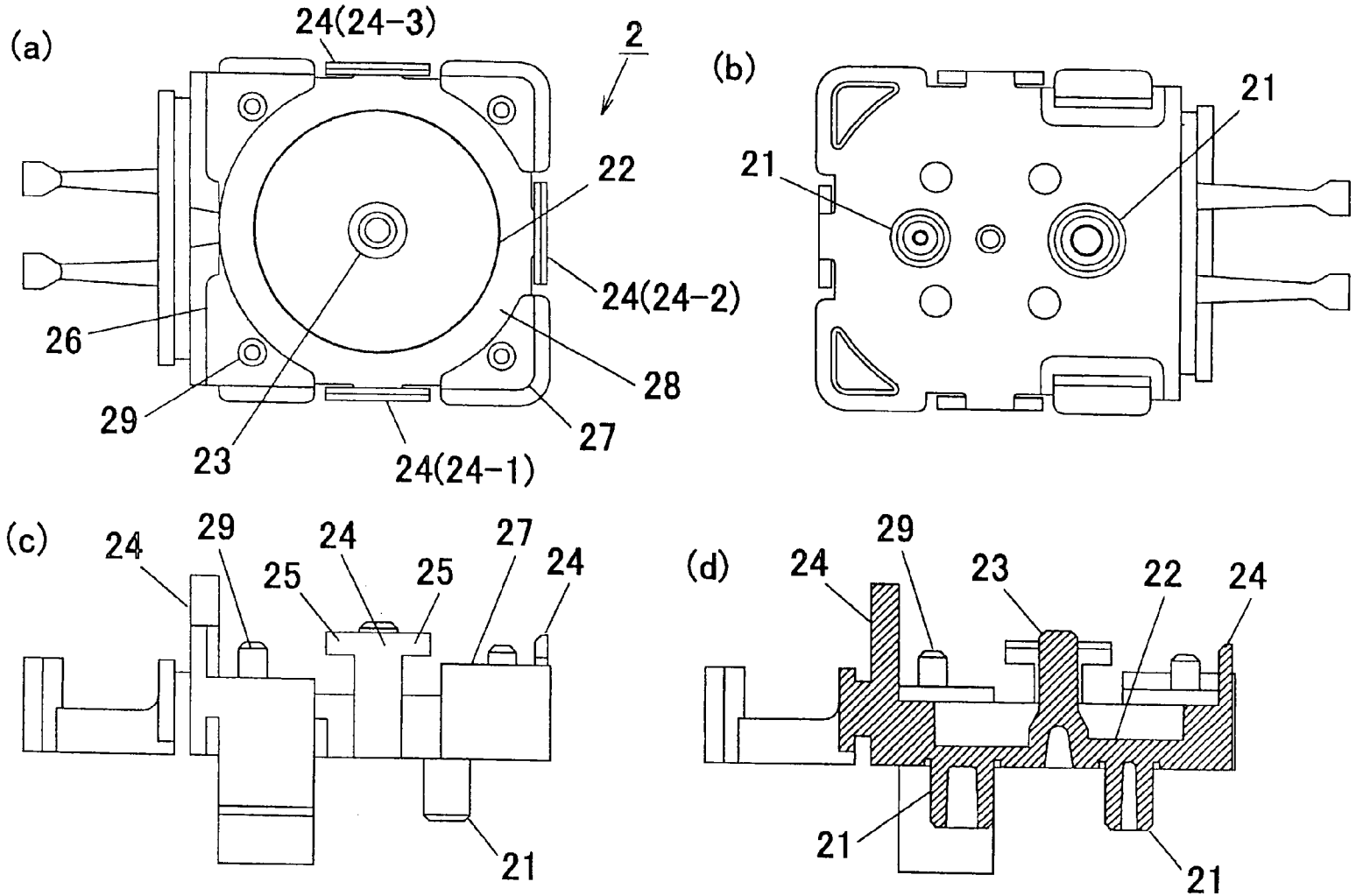
FIG. 3 shows a base; (a) is a top view, (b) is a bottom view, (c) is a front view and (d) is a cross-sectional view.
Figure 4:
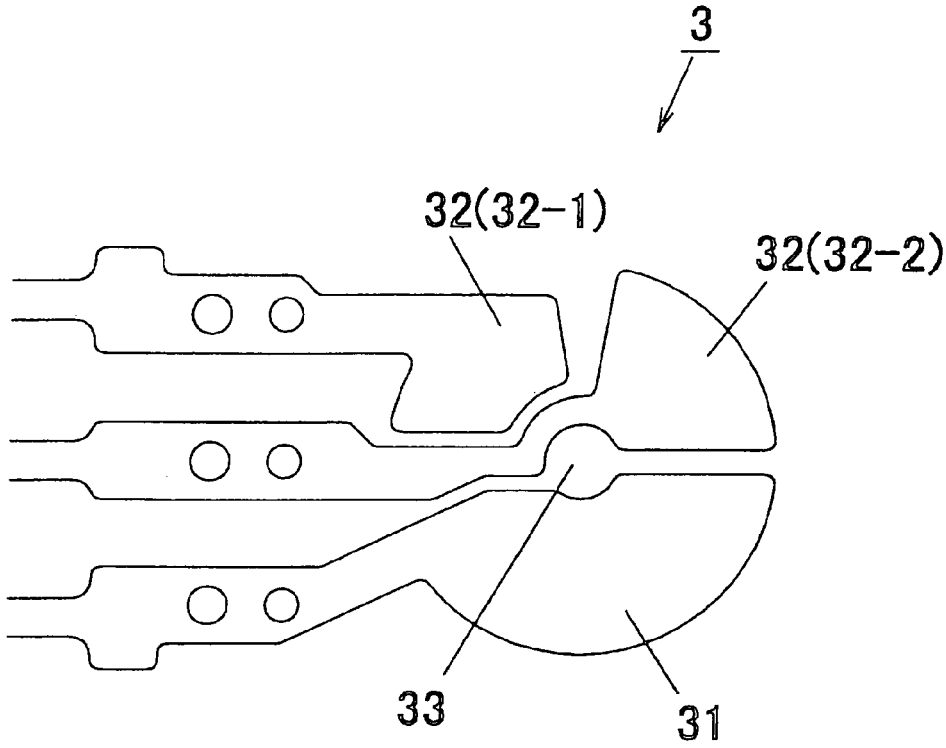
FIG. 4 is a top view showing the construction of a fixed contact.
Figure 5:
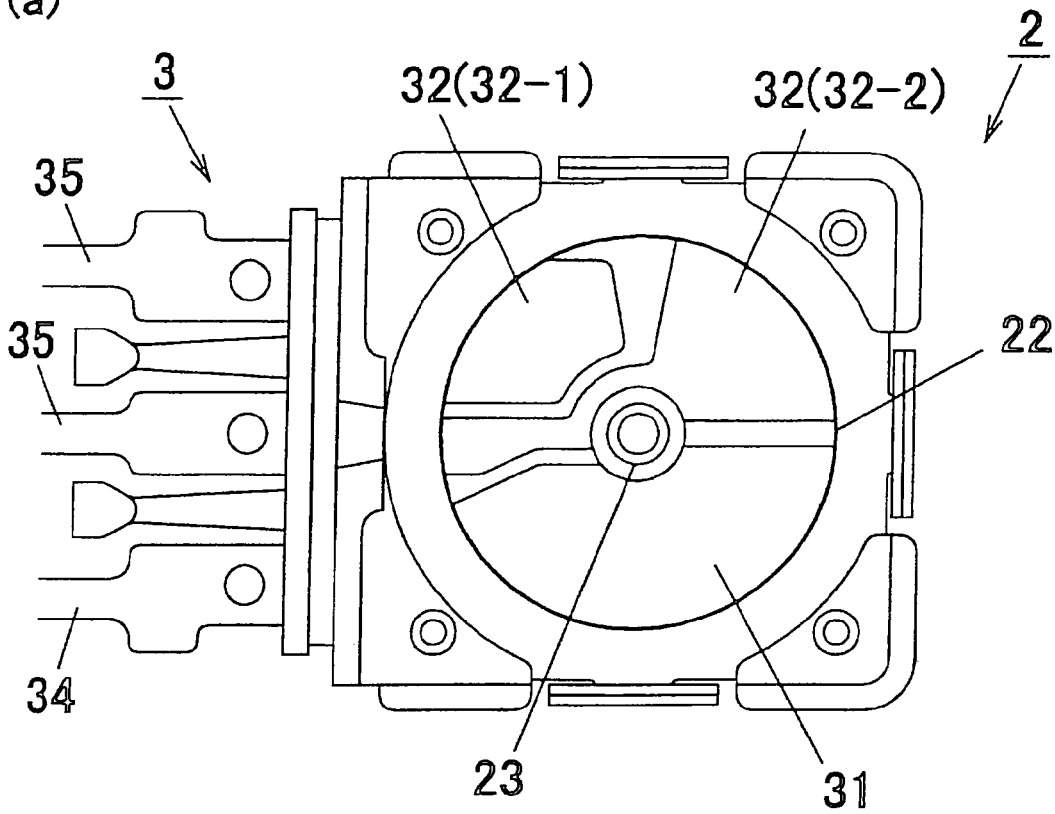
FIG. 5 shows the fixed contact attached to the base; (a) is a top view and (b) is a cross-sectional view.
Figure 5:
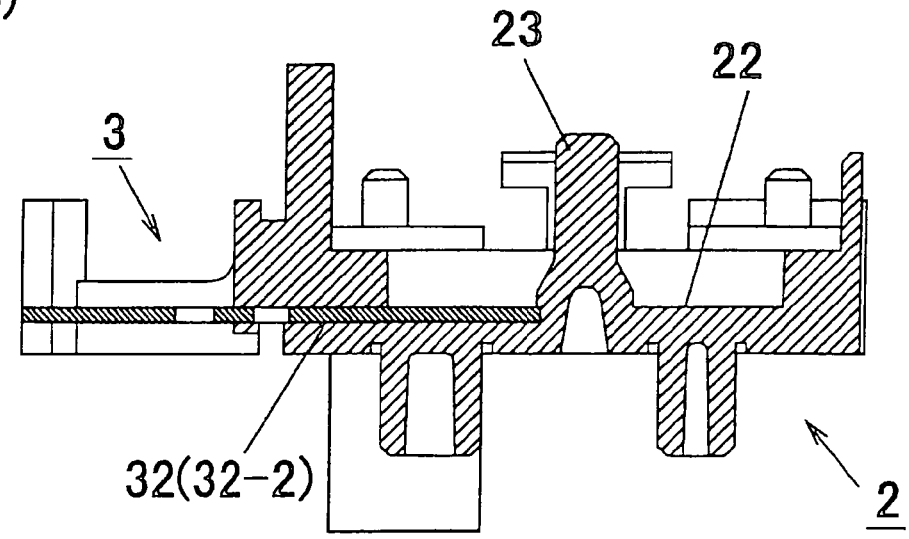

First, the fixed contact is attached to the base (see FIGS. 3, 4, 5).

The base 2 shown in FIG. 3 is made of an insulating resin material, includes two legs 21, 21 on the bottom surface and a circular recess 22 at substantially the center of the top surface. A cylindrical boss 23 is disposed upright at the center position in this circular recess 22 which serves as the rotation center of the operation lever 4. Furthermore, barriers 24 which surround the circular recess 22 are provided on the sides of the base 2. Of these barriers, barriers 24-1, 24-2, 24-3 located on the front, right side and rear side are T-shaped as shown in FIG. 3(*c*) and provided with a pair of engagement sections 25 at the top end.

The perimeter of the circular recess 22 serves as a pedestal 26 for fixing the casing 5 which will be described later and mounts 27 which rise one step above the base are formed in the four corners of this pedestal 26 and a ring pedestal 28 is provided inside. Furthermore, protrusions 29, 29, . . . are formed on the mounts 27.

The fixed contact 3 shown in FIG. 4 is molded by punching out a conductive metal plate and provided with a semicircular common fixed contact 31 and a pair of side fixed contacts 32 obtained by dividing a semicircle into two portions. The contours of this common fixed contact 31 and side fixed contacts 32 follow the shape of the circular recess 22 of the base 2. A circular hole 33 through which the boss 23 of the base 2 passes is formed at the center of the circular recess 22.

As shown in FIG. 5, the fixed contact 3 is fixed to the base 2. That is, by inserting the fixed contact 3 from one side of the base 2, the common fixed contact 31 is disposed at the front position of the floor surface within the circular recess 22 and a common fixed terminal 34 connected thereto protrudes outward from the side front of the base 2. The side fixed contacts 32 are disposed at the rear positions of the floor surface within the circular recess 22 and separated from each other to be symmetrically positioned. Note that a side fixed terminal 35 connected to the left side fixed contact 32-1 and a side fixed terminal 35 connected to the right side fixed contact 32-2 protrude outward from the side rear of the base 2 and the side center of the base 2, respectively.

Figure 6:
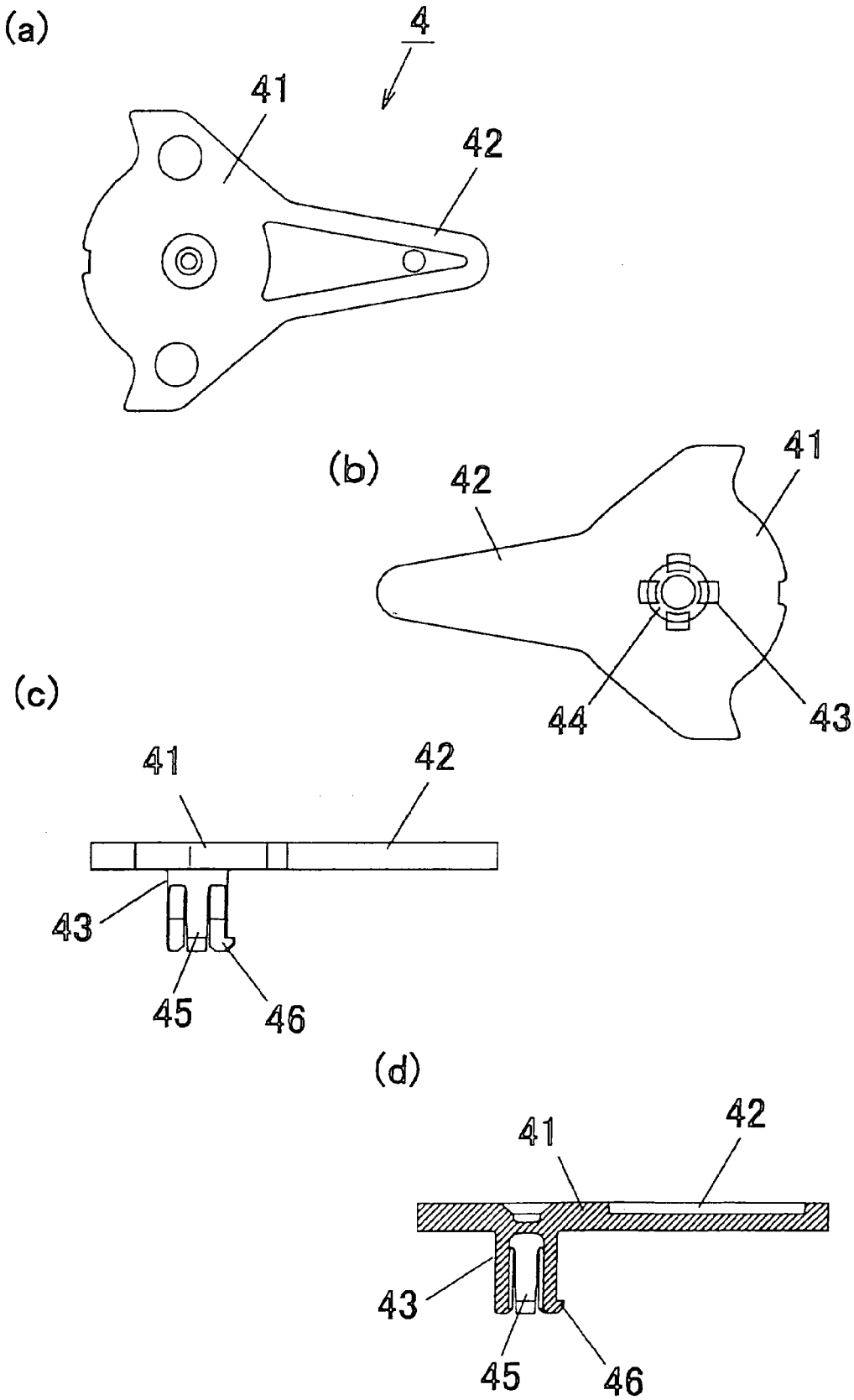
FIG. 6 shows an operation lever; (a) is a top view, (b) is a bottom view, (c) is a front view and (d) is a cross-sectional view.
Figure 7:
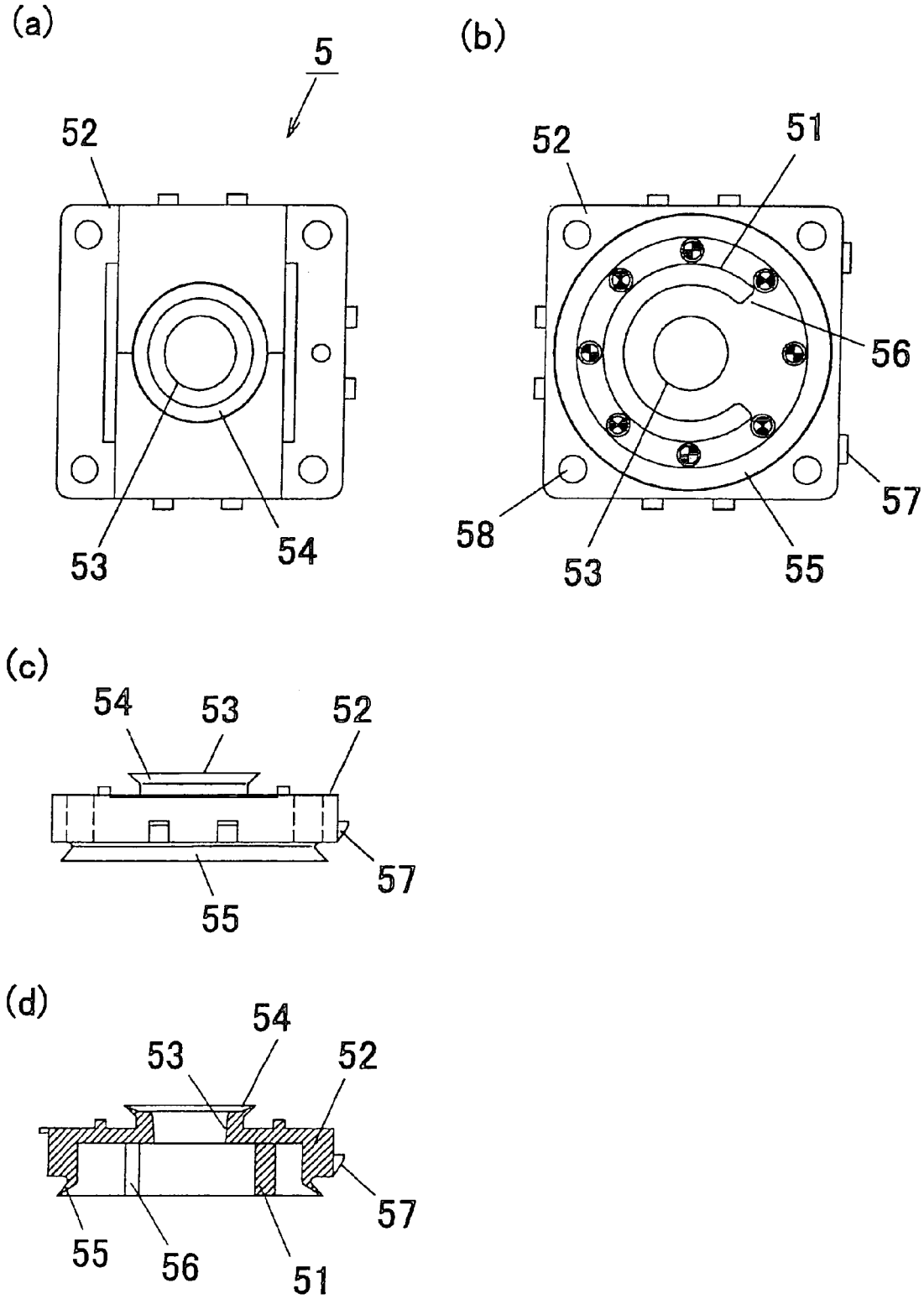
FIG. 7 shows a casing; (a) is a top view, (b) is a bottom view, (c) is a front view and (d) is a cross-sectional view.
Figure 8:
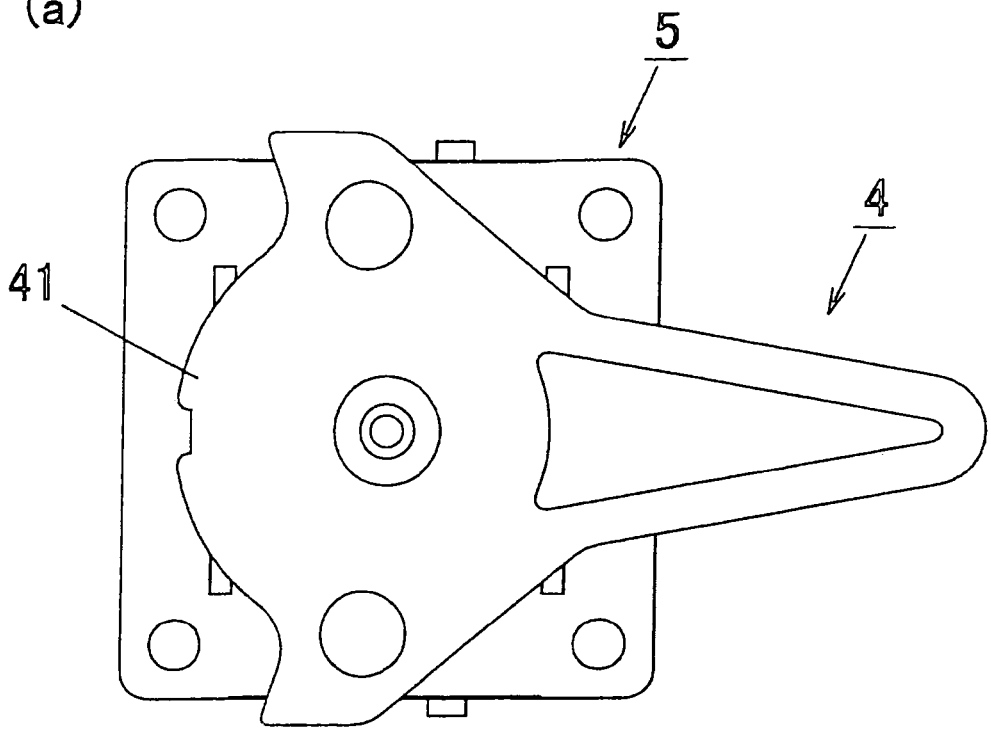
FIG. 8 shows the casing attached to the operation lever; (a) is a top view and (b) is a cross-sectional view.
Figure 8:
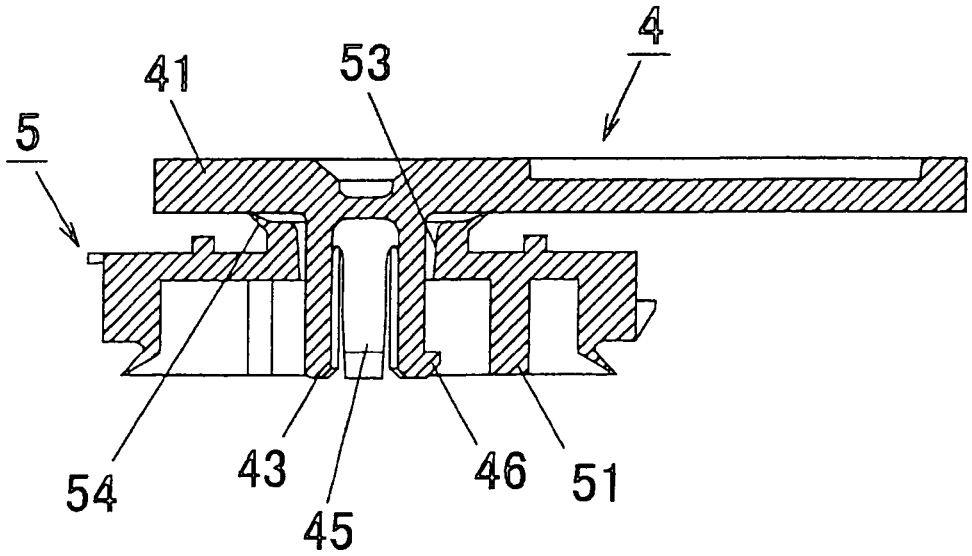

Next, the casing is attached to the operation lever (see FIGS. 6, 7, 8).

The operation lever 4 shown in FIG. 6 is made of an insulating resin material and consists of a disk 41, a lever 42 laterally protruding from the disk 42 and a shaft 43 protruding downward from the center of the disk 42. The shaft 43 is rotatably supported to the boss 23 of the base 2. Thus, the operation lever 4 is supported rotatable around the boss 23.

A cross-figured slit 44 is formed in the shaft 43 in the radial direction thereof viewed from the underside as shown in FIG. 6(*b*) and divided into four shaft split pieces 45, 45, . . . The reason for adopting this split structure is to make it easier to insert the shaft split pieces 45 into an inner cylinder 51 by puckering the tips thereof when the casing 5 which will be described later is attached and insert each shaft split piece 45 into an insertion section 74 of a shaft hole 73 for positioning and fixing when the rotor 7 which will be described later is attached. Note that each shaft split piece 45 is provided with a stopper lug 46 whose end is bent outward.

The casing 5 shown in FIG. 7 is formed of a rubber elastic body having flexibility and has a double structure provided with the inner cylinder 51 which accommodates the rotor 7 which will be described later and an outer case 52 which surrounds the perimeter of this inner cylinder 51. A shaft insertion hole 53 having substantially the same inner diameter as the outer diameter of the shaft 43 of the operation lever 4 and communicating with the interior of the inner cylinder 51 is provided on the top surface of the outer case 52.

An upper lip packing 54 formed into a small diameter ring than the disk 41 of the operation lever 4 is provided at the top end of the shaft insertion hole 53. On the other hand, a lower lip packing 55 having the same diameter as that of the ring pedestal 28 of the base 2 is provided at the bottom of the outer case 52. According to this embodiment, all these inner cylinder 51, outer case 52, shaft insertion hole 53, upper lip packing 54 and lower lip packing 55 are formed of thermoplastic polyester elastomer as a single piece. Both the upper lip packing 54 and lower lip packing 55 are L-figured packings having an L-figured section, but they may also be U-shaped packings or V-shaped packings instead.

A fan notch 56 is notched in a fan shape on the outer wall of the inner cylinder 51 as shown in FIG. 7(*b*). The opening angle of this fan notch 56 is set to the rotation angle of the operation lever 4 (60 degrees to the right and left in this embodiment). Moreover, a pair of engagement lugs 57 to be engaged with the engagement sections 25 of the base 2 are formed on the front, right side and rear side of the outer case 52 and holes 58 to be engaged with the protrusions 29 of the base 2 are formed in the four corners of the bottom surface.

As shown in FIG. 8, the casing 5 is attached to the underside of the operation lever 4. That is, the shaft 43 of the operation lever 4 is inserted from the shaft insertion hole 53 of the casing 5 into the inner cylinder 51. During this insertion, the stopper lug 46 at the end of the shaft split pieces 45 is pressed against the inner wall of the shaft insertion hole 53, the shaft split pieces 45 advance inside the shaft insertion hole 53 with the tips of shaft split pieces 45 puckered inward and when the shaft split pieces 45 come out into the inner cylinder 51, they are released from the pressure and expand and open. This prevents the operation lever 4 from coming off the casing 5 and causes the top surface of the upper lip packing 54 to be pressed against the underside of the disk 41.

Figure 9:
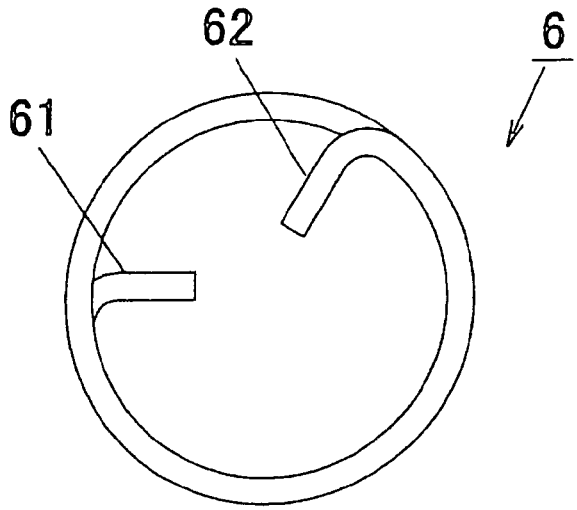
FIG. 9 shows a coil spring; (a) is a top view and (b) is a front view.
Figure 9:
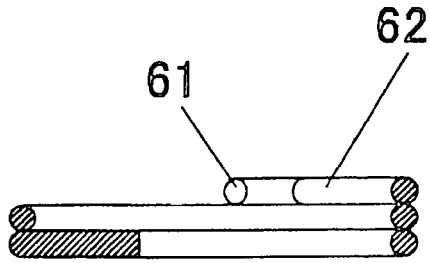
Figure 10:
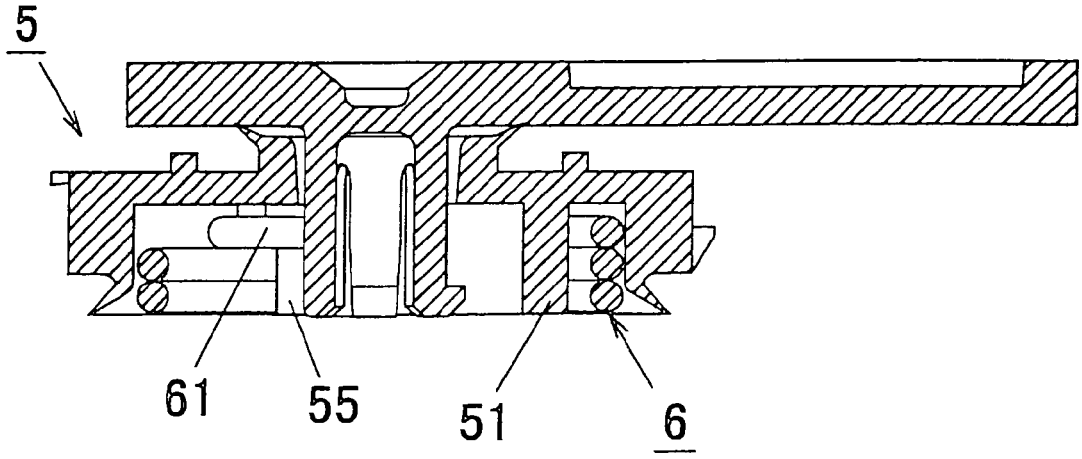
FIG. 10 is a cross-sectional view of the coil spring attached to the casing.

Next, a coil spring is attached to the casing (see FIGS. 9, 10).

The coil spring 6 shown in FIG. 9 is a stainless steel wire wound in a coil shape and has a middle diameter between that of the outer peripery of the inner cylinder 51 and that of the inner periphery of the outer case 52. The coil spring 6 has a beginning tip bent part 61 and end tip bent part 62 bent at ends, and those tip bent parts respectively stand vertical. The angle between the tip bent parts around the coil center is rather wider than the opening angle of the casing fan notch 56, so that the coil spring would be hooked at and fixed to the casing fan notch 56, with the tip bent parts respectively pressing the corresponding notch ends by the elastic torsional force.

As shown in FIG. 10, the coil spring 6 is mounted inside the casing 5. That is, the coil spring 6 is inserted from the bottom face of the casing 5 around the perimeter of the inner cylinder 51, and hooked at and fixed to the fan notch 56, with the beginning tip bent part 61 and end tip bent part 62 of the coil spring 6 respectively pressing to the corresponding notch ends of the casing fan notch 56 of the inner cylinder 51.

Figure 11:
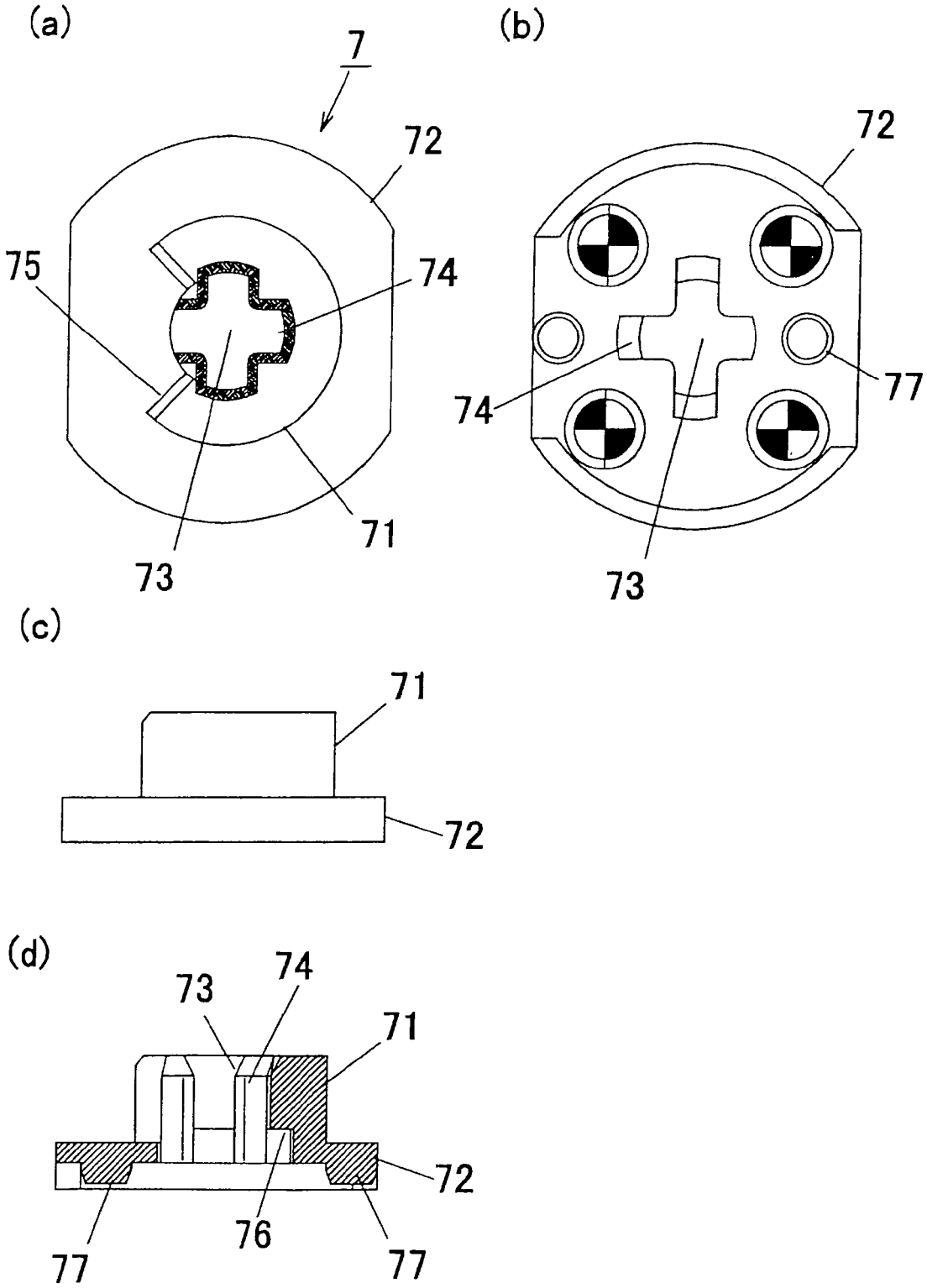
FIG. 11 shows a rotor; (a) is a top view and (b) is a bottom view, (c) is a front view and (d) is a cross-sectional view.
Figure 12:
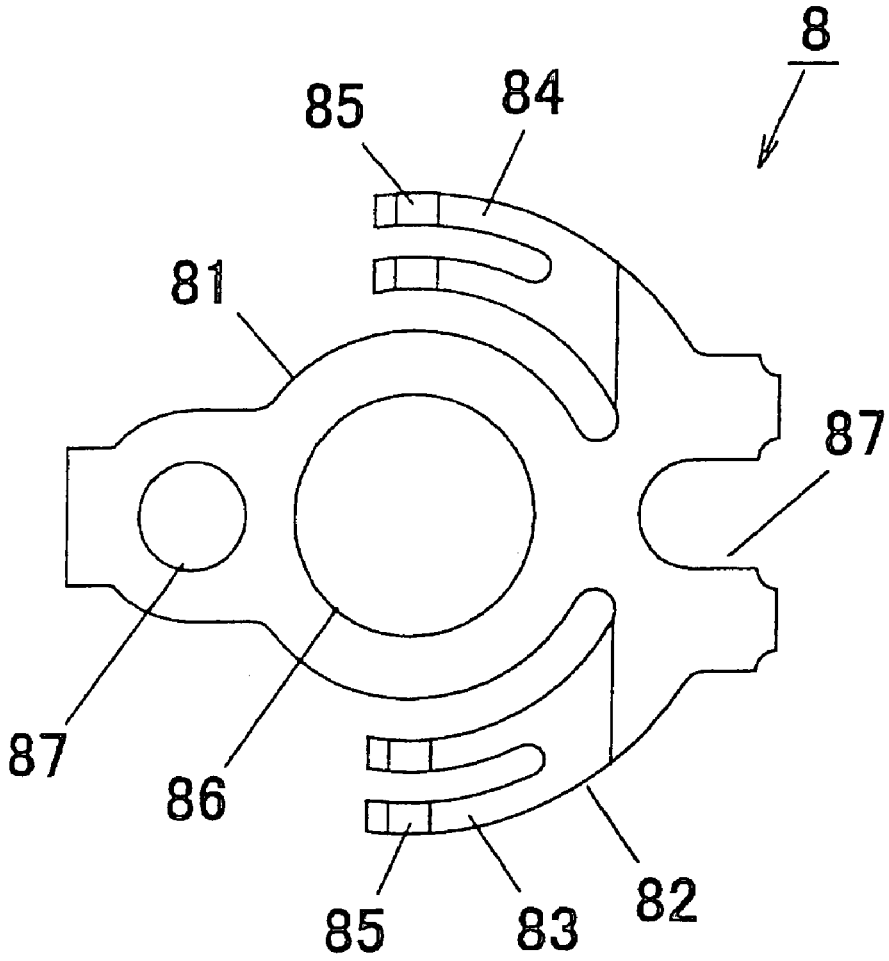
FIG. 12 shows a movable contact; (a) is a top view and (b) is a front view.
Figure 12:
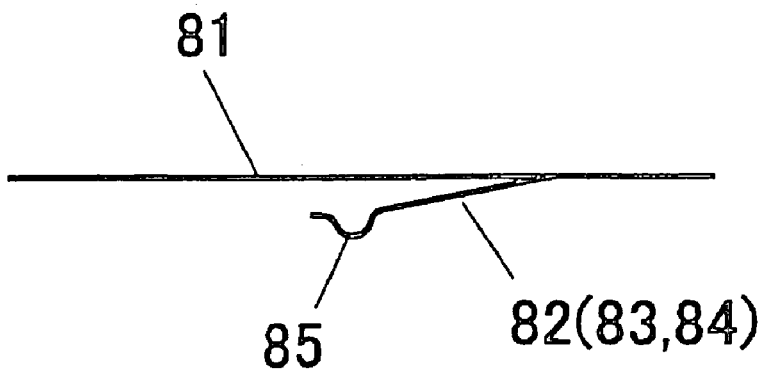
Figure 13:
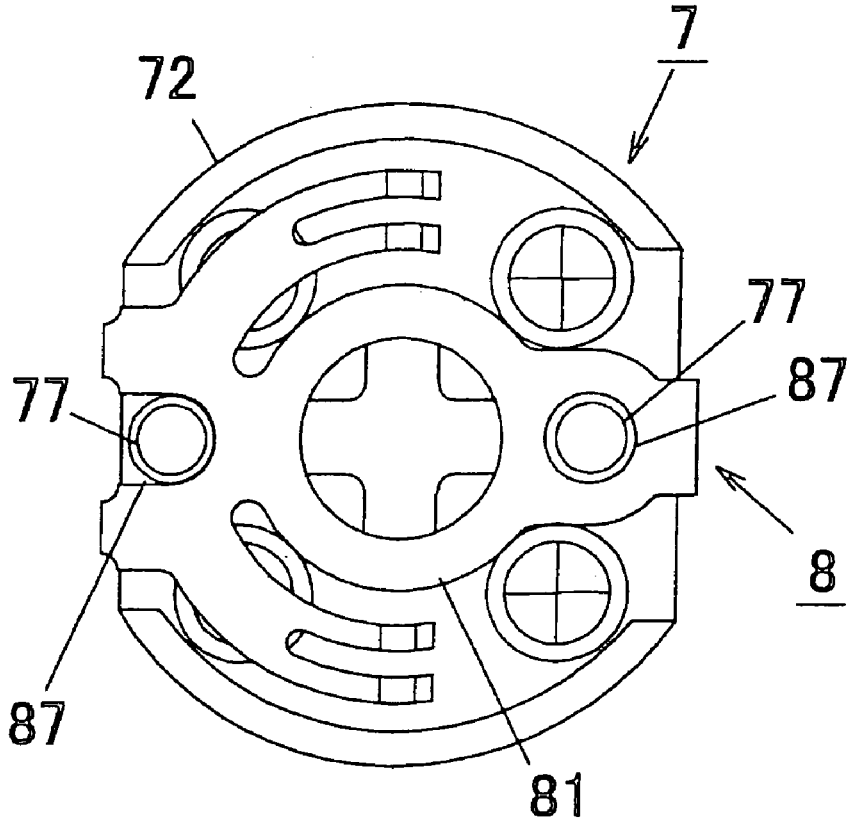
FIG. 13 show a movable contact attached to the rotor; (a) is a bottom view and (b) is a cross-sectional view.
Figure 13:
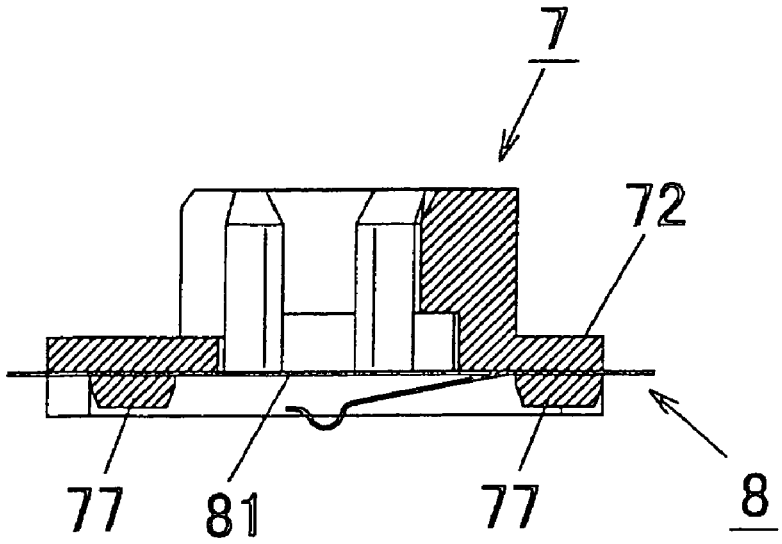

Next, a movable contact is attached to the rotor (see FIGS. 11, 12, 13).

The rotor 7 shown in FIG. 11 is made of an insulating resin material and provided with a cylinder section 71 and a disk-shaped flange 72 extending around the lower end of the cylinder section 71. A shaft hole 73 which is cross-figured when viewed from the end face is formed at the center of the cylinder section 71 as shown in FIG. 11(*b*). The shaft hole 73 includes an insertion section 74 which extends in four directions in the periphery and these four insertion sections 74, 74, . . . are designed to position and fix the four inserted shaft split pieces 45, 45, . . . of the operation lever 4.

As shown in FIG. 11(*a*), a fan notch 75 is notched and formed in a fan shape on the outer wall of the cylinder section 71. This fan-shaped opening angle is also set to the rotation angle of the operation lever 4, as the opening angle of the casing fan notch 56 of the casing 5. Furthermore, a stepped part 76 with which the stopper lug 46 of the shaft 43 is engaged is formed at the bottom of the cylinder section 71 and mounting pins 77 for mounting the movable contact 8 are provided on the underside of the flange 72.

The movable contact 8 shown in FIG. 12 is formed by punching out a conductive metal plate and consists of a mounting strip 81 set at the center and contact spring strips 82 set on both sides of the mounting strip 81, connected as a single piece at the root. A circular through hole 86 through which the boss 23 of the base 2 passes is formed at the center of the mounting strip 81 and mounting holes 87 are formed at the root and the end thereof.

One side of the contact spring strip 82 serves as a common contact spring strip 83 and the other side serves as a side contact spring strip 84. As shown in FIG. 12(*b*), the common contact spring strip 83 is bent downward from the horizontal plane to provide a spring force and includes a contact section 85, the end of which is bifurcated and bent downward. The side contact spring strip 84 is likewise bent downward from the horizontal plane to provide a spring force and includes a contact section 85, the end of which is bifurcated and bent downward.

As shown in FIG. 13, the movable contact 8 is fixed to the bottom surface of the rotor 7. That is, the mounting pins 77 in the flange 72 of the rotor 7 are engaged with the mounting holes 87 formed in the mounting strip 81, both are heat-welded so as to unite the rotor 7 and movable contact 8.

Figure 14:
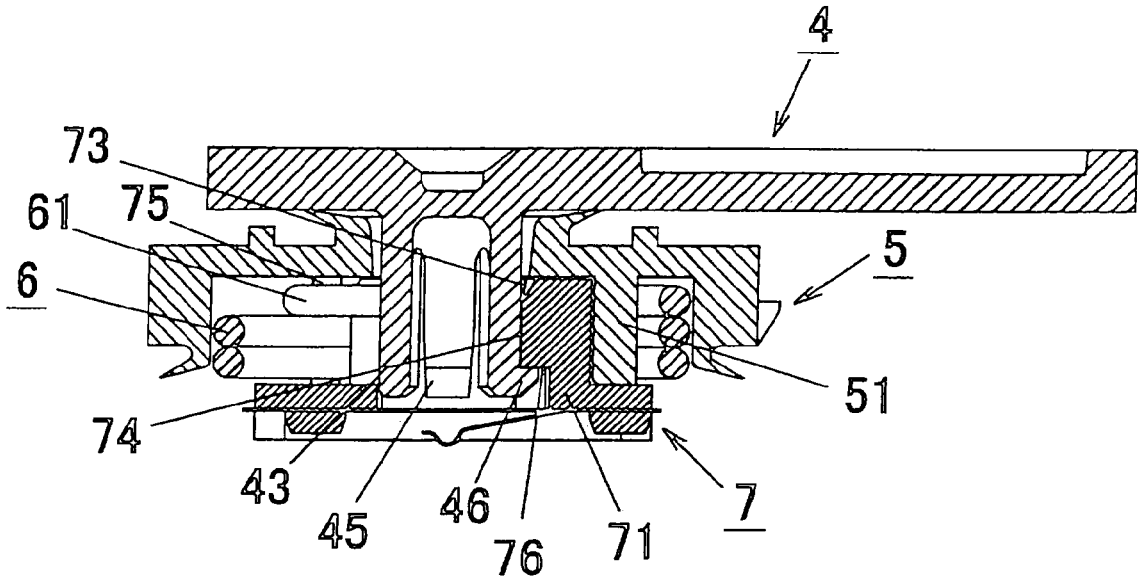
FIG. 14 is a cross-sectional view showing the rotor attached to the operation lever.

Furthermore, the rotor is attached to the operation lever (see FIGS. 10, 13, 14).

The rotor 7 shown in FIG. 13 attached to the underside of the operation lever 4 shown in FIG. 10 appears as shown in FIG. 14. That is, the shaft 43 of the operation lever 4 is inserted into the cylinder section 71 of the rotor 7. When the respective shaft split pieces 45 are inserted into the insertion sections 74 of the shaft hole 73 and both are positioned, the rotor 7 is accommodated in the inner cylinder 51 of the casing 5. During this insertion, the respective shaft split pieces 45 advance inside the insertion section 74 with the tips of the shaft split pieces 45 puckered inward and expand and open when they come out of the bottom of the cylinder section 71 and the stopper lug 46 is engaged with the stepped part 76. In this way, the operation lever 4 is reliably fixed so as not to slip off the rotor 7.

The rotor 7 is accommodated in the inner cylinder 51 of the casing 5 and the beginning tip bent part 61 and end tip bent part 62 of the coil spring 6 around the perimeter of the inner cylinder 51 are hooked at and fixed to the rotor fan notch 75 as well as the casing fan notch 56, tip bent parts of the coil spring 6 respectively pressing to the corresponding notch ends of the rotor fan notch 75 and the casing fan notch 56. Thus, the operation lever 4 fixed to the rotor 7 remains biased by the coil spring 6 all the time, biasing the operation lever to a neutral position on the base.

Finally, the operation lever is attached to the base (see FIG. 2, FIG. 5, FIG. 14).

When the operation lever 4 shown in FIG. 14 is attached to the top surface of the base 2 shown in FIG. 5, the lever switch 1 shown in FIG. 2 is completed. That is, the shaft 43 of the operation lever 4 is engaged with the boss 23 of the base 2. In this way, the operation lever 4 is supported at the center of the boss 23 in a freely rotational manner.

The casing 5 is attached to the pedestal 26 of the base 2. The mounts 27 are disposed in the four corners of the pedestal 26 and by engaging the protrusions 29 with the holes 57 at the bottom of the outer case 52, the casing 5 can be attached to the base 2 through one-touch operation. Furthermore, the engagement lugs 56 of the outer case 52 are engaged with the engagement sections 25 of the barrier 24 and the joint surface between the outer case 52 and base 2 is heat-welded. This causes the casing 5 to be fixed to the base 2 and accommodated inside the barriers 24.

Inside the joint surface between the outer case 52 and base 2, the lower lip packing 55 is placed on the ring pedestal 28 and the underside thereof is pressed against the ring pedestal 28, thus forming a sealed structure.

Figure 15:
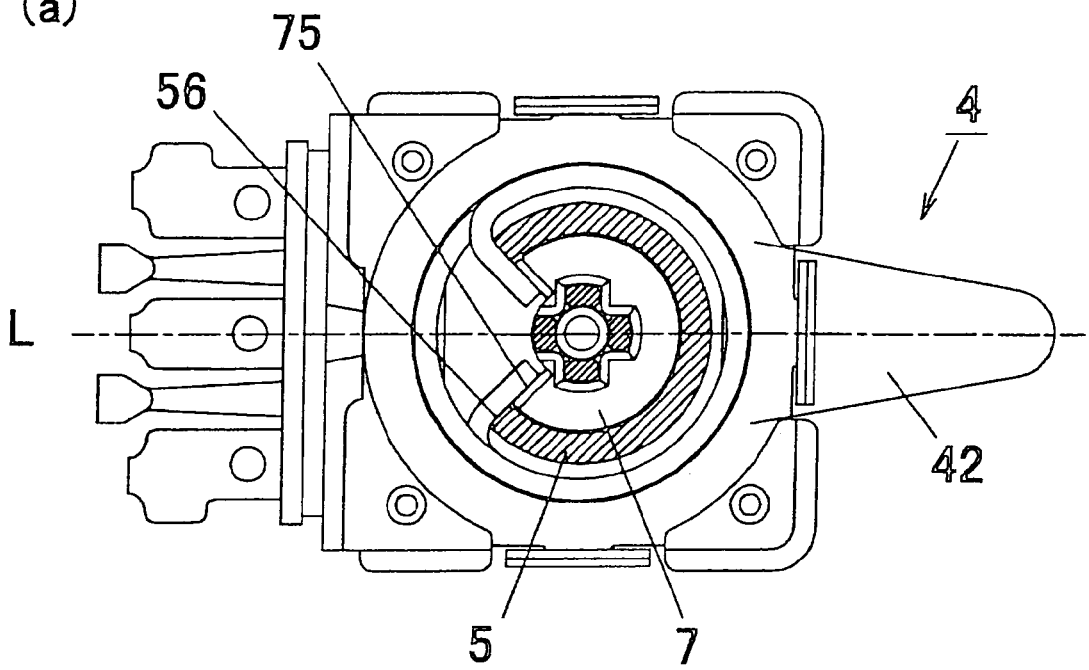
FIG. 15 shows the lever switch in a stationary position; (a) shows a relationship between the rotor and casing and (b) shows a relationship between the movable contact and fixed contact.
Figure 15:
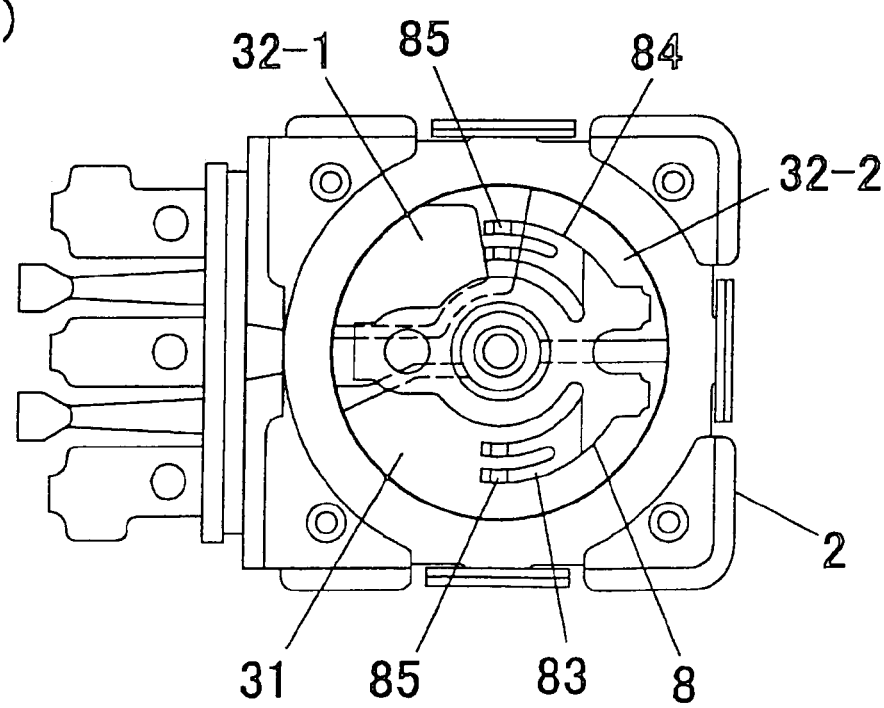
Figure 16:
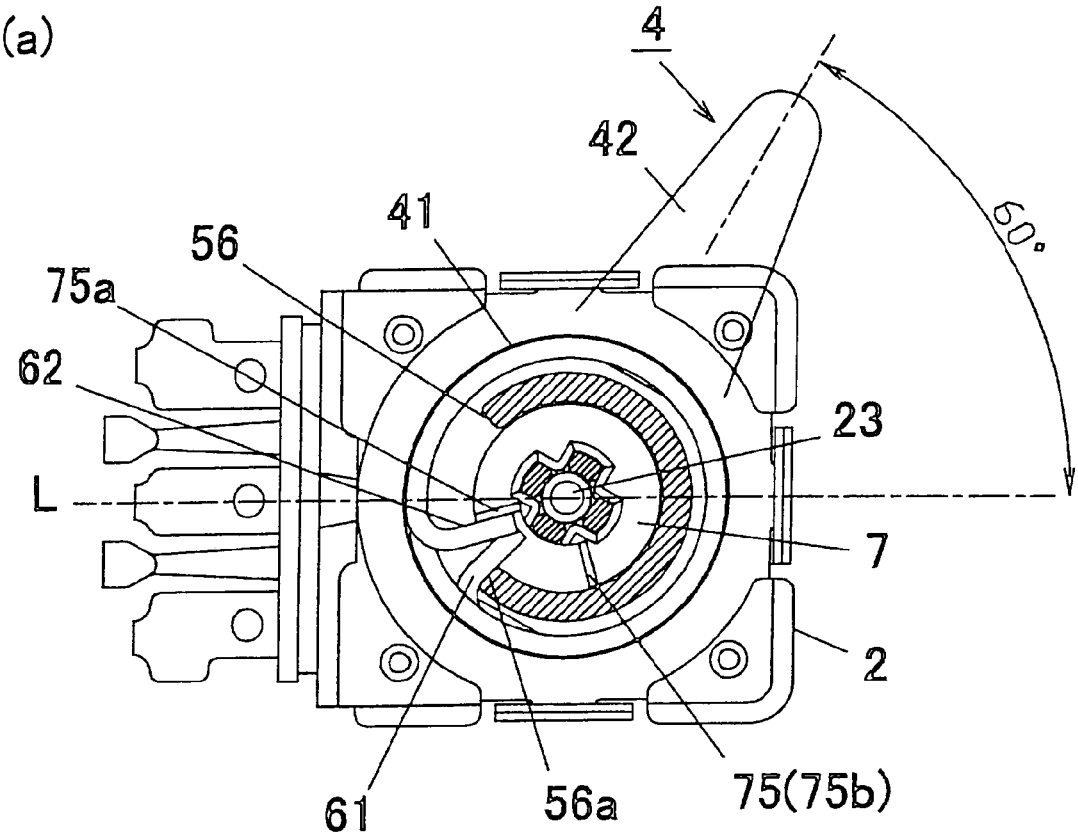
FIG. 16 shows a situation in which a leftward force acts on the lever switch; (a) shows a relationship between the rotor and casing and (b) shows a relationship between the movable contact and fixed contact.
Figure 16:
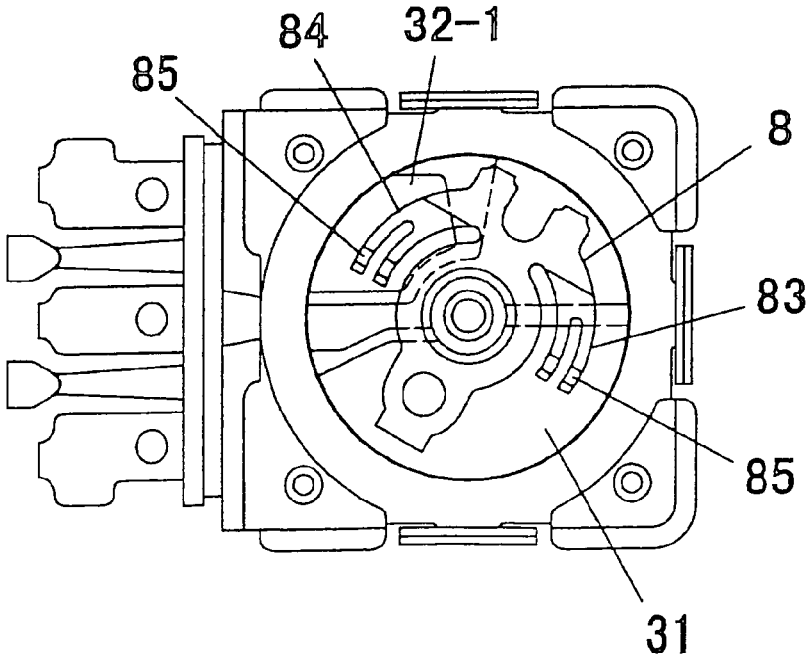
Figure 17:
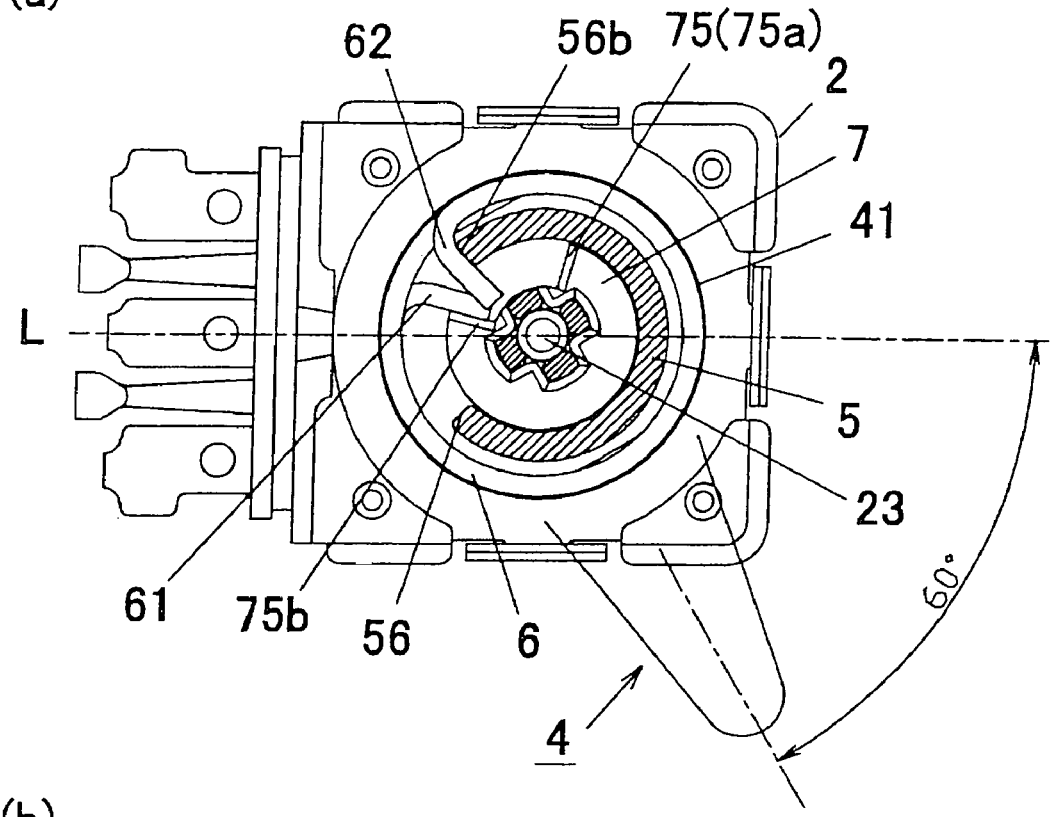
FIG. 17 shows a situation in which a rightward force acts on the lever switch; (a) shows a relationship between the rotor and casing and (b) shows a relationship between the movable contact and fixed contact.
Figure 17:
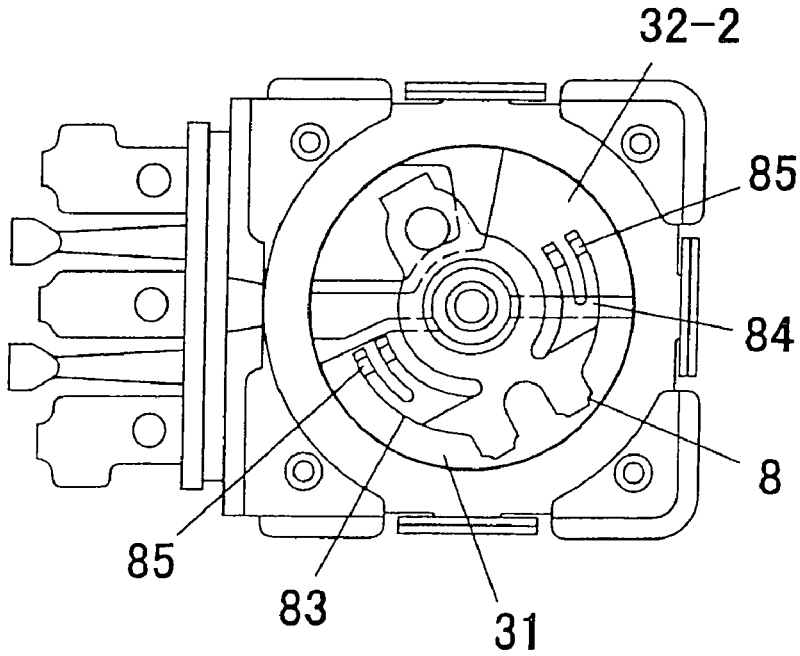

This is the structure of the lever switch 1 according to this embodiment. The operation and action of this switch 1 will be explained below with reference to FIGS. 2, 15, 16, and 17. In FIG. 15 to FIG. 17, perspective views of the switch mechanism viewed from above the operation lever 4 are shown to facilitate an understanding of the operations of the respective sections.

As shown in FIG. 15, when no load is applied to the operation lever 4, the lever 42 is located at the neutral position on a center line L of the base 2. In the switch mechanism, the rotatable rotor 7 and the fixed casing 5 are arranged concentrically so that the opening angle of the fan notch 75 of the rotor 7 coincides with that of the fan notch 56 of the casing 5. In non-load condition, as shown in FIG. 15(*b*), at the movable contact 8 fixed to the bottom surface of the rotor 7, the contact part 85 of the common contact spring strip 83 contacts the common fixed contact 31 on the base 2, whereas the contact part 85 of the side contact spring strip 84 contacts none of the left and right side fixed contacts 32-1, 32-2 and there is no electrical connection and the switch is placed in an OFF state.

From this switch-OFF state, if an external force in the left direction in the figure acts on the operation lever 4 as shown in FIG. 16, the disk 41 rotates around the boss 23 of the base 2 counterclockwise. Furthermore, interlocked with the rotation operation of the disk 41, the rotor 7 also rotates counterclockwise and the fan notch 75 of the rotor 7 also rotates simultaneously, whereas the fan notch 56 of the casing 5 does not rotate and remains in the same position.

That is, the rotor fan notch 75 rotates around the center of the rotor 7 leaving behind the casing fan notch 56. The beginning tip bent part 61 of the coil spring 6 remains immobile hooked at one end 56*a* of the casing fan notch 56, while only the end tip bent part 62 rotates by being pressed by one surface 75*a* of the rotor fan notch 75 and the other surface 75*b* of the rotor fan notch 75 moves away from the beginning tip bent part 61. In this way, the coil spring 6 is stretched torsional while rotating counterclockwise around the beginning tip bent part 61 which remains immobile.

Accompanying this series of rotation operations, as shown in FIG. 16(*b*), the movable contact 8 fixed to the bottom surface of the rotor 7 also rotates counterclockwise. Then, the contact part 85 of the common contact spring strip 83 rotates and moves always in contact with the common fixed contact 31 and the contact part 85 of the side contact spring strip 84 contacts the left side fixed contact 32-1 through this rotational movement. In this way, the common fixed contact 31 and the left side fixed contact 32-1 contact each other via the movable contact 8, and therefore both are electrically connected, producing a switch-ON state.

When the external force acting on the operation lever 4 is released from this switch-ON state, the operation lever 4 is automatically restored to the neutral position by the elastic force of the coil spring 6. That is, the coil spring 6 stretched as described above contracts to return to its original state by its own elastic force when released from the pressure of the rotor fan notch 75. For this reason, the one surface of the rotor fan notch 75 is pushed back to the end tip bent part 62 by the contracting force of the coil spring 6. This causes the rotor 7 to rotate clockwise and the disk 41 of the operation lever 4 also rotates clockwise interlocked with this rotation operation and is restored to the neutral position on the center line L. In this way, as shown in FIG. 15, the connection between the common fixed contact 31 and the left side fixed contact 32-1 is interrupted and the switch is placed in an OFF-state.

On the other hand, as shown in FIG. 17, when an external force in the right direction in the figure opposite to that in FIG. 16 acts on the operation lever 4, the disk 41 rotates around the boss 23 of the base 2 clockwise. Interlocked with the rotation operation of this disk 41, the fan notch 75 of the rotor 7 also rotates clockwise simultaneously, whereas the fan notch 56 of the casing 5 does not rotate and remains in the same position.

That is, the rotor fan notch 75 rotates around the center of the rotor 7 leaving behind the casing fan notch 56. However, now the end tip bent part 62 of the coil spring 6 remains immobile hooked at the other end 56*b* of the casing fan notch 56 and, whereas only the beginning tip bent part 61 rotates by being pressed against the other surface 75*b* and the one surface 75*a* of the rotor fan notch 75 moves away from the end tip bent part 62. This causes the coil spring 6 to be stretched torsional by rotating clockwise around the end tip bent part 62 which remains immobile.

Accompanying this series of rotation operations, as shown in FIG. 17(*b*), the movable contact 8 fixed to the bottom surface of the rotor 7 also rotates clockwise. Then, the contact part 85 of the common contact spring strip 83 rotates and moves in contact with the common fixed contact 31 all the time and the contact part 85 of the side contact spring strip 84 contacts the right side fixed contact 32-2 through this rotational movement. In this way, the common fixed contact 31 and the right side fixed contact 32-2 are connected together via the movable contact 8, and therefore both are electrically connected, producing a switch-ON state. The restoring operation of the operation lever 4 by an elastic force of the coil spring 6 is as shown above.

In this way, with regard to the switch mechanism, when the operation lever 4 rotates leftward or rightward from the neutral position against the spring force of the coil spring 6, the rotor 7 fixed to the operation lever 4 also rotates interlocked therewith, the side contact spring strip 84 of the movable contact 8 fixed to the bottom surface of the rotor 7 contacts only one of the left and right side fixed contacts 32-1, 32-2 fixed to the base 2 and the switch is turned on. On the other hand, when the operation lever 4 is restored to the neutral position through an elastic force of the coil spring 6, the side contact spring strip 84 interlocked with the rotation of the rotor 7 moves away from the side fixed contact 32 which has been in contact so far and the switch is turned off.

As shown in FIG. 2, the waterproof/dustproof mechanism is constructed in such a way as to fill the gap between the base 2 and operation lever 4 with the casing 5 and accommodate the switch mechanism in the casing 5. Furthermore, the sliding surface between the operation lever 4 and casing 5 is sealed by the upper lip packing 54 which is integrated with the casing 5 in close contact therewith and the contact surface between the base 2 and casing 5 is also sealed by the lower lip packing 55 which is integrated with the casing 5 in close contact therewith.

Furthermore, the joint surface heat-welded between the outer case 52 and base 2 is arranged outside the lower lip packing 55. For this reason, the double structure of the heat-welded joint surface and the sealed surface of the lower lip packing 55 eliminates any room for intrusion of water, dust or the like from the outside of the casing 5 into the internal switch mechanism, eliminates trouble such as rusting of the metal parts, clogging of the coil spring or the like, and therefore it is possible to maintain the smooth operation of the switch mechanism for a long period of time.

Furthermore, in the waterproof/dustproof mechanism, the casing 5 is accommodated inside the barriers 24 of the base 2 and the sealed surface of the lower lip packing 55 is not exposed outside the switch, and therefore the barriers 24 can block water, dust or the like intruding from the sealed surface and prevents factors for operational faults from occurring in the switch mechanism.

Furthermore, the casing 5 is characterized in that the diameter of the upper lip packing 54 pressed against the operation lever 4 is set to be smaller than the diameter of the lower lip packing 55 pressed against the base 2. In this way, when the operation lever 4 rotates, the sliding friction resistance between the disk 41 and upper lip packing 54 is reduced and only a small operational force of the operation lever 4 is required, making it possible to realize much smoother operation of the switch mechanism.

Note that in this lever switch 1, the common fixed terminal 34 connected to the common fixed contact 31 protrudes from the side of the base 2 and the side fixed terminals 35 connected to the left and right side fixed contacts 32-1, 32-2 protrudes out of the base 2, but as shown in FIG. 1, a cover 9 is provided to cover these fixed terminals 34, 35 and lead wires 88 welded thereto. This construction keeps the fixed terminals 34, 35 made of a metal plate completely shut out from the outside and reliably prevents trouble such as rusting and can further improve durability.

What is claimed is:

1. A lever switch comprising:

a base having a circular recess on a top surface thereof;

a common fixed contact fixed to an interior of the circular recess;

a pair of side fixed contacts fixed at symmetric positions inside the circular recess separated from each other;

an operation lever consisting of a disk, a lever laterally protruding from the disk and a shaft protruding downward from the center of the disk, the shaft being rotatably supported to a boss which vertically protrudes from the center of the circular recess;

a rotor fixed to the shaft of the operation lever and provided with a fan notch notched in a fan shape on the outer wall thereof at a predetermined angle;

a common contact spring strip fixed to an underside of the rotor and having contact with the common fixed contact;

a side contact spring strip fixed to an underside of the rotor and having contact with or separate from the side fixed contact;

a double-structure casing fixed to the base and holding the rotor therein and consisting of an inner cylinder and an outer case, the inner cylinder surrounding the rotor and the outer case having a fan notch notched in a fan shape on the an outer wall thereof at the same angle as the fan notches of the rotor;

a coil spring wound around a perimeter of the inner cylinder, hooked at and fixed to both the fan notch, one tip bent part thereof pressing to one notch end of the rotor fan notch and one notch end of the casing fan notch, the other tip bent part to the others, to bias the operation lever to a neutral position on the base;

an upper lip packing provided on a top surface of the casing in a ring shape and pressed against an underside of the disk; and a lower lip packing provided on an underside of the outer case in a ring shape and pressed against a perimeter of the circular recess.

2. The lever switch according to claim 1, further comprising barriers surrounding the circular recess on a side of the base, wherein the casing is accommodated inside the barriers.

3. The lever switch according to claim 1, further the base comprises a ring pedestal around a perimeter of the circular recess and mounts outside the ring pedestal, the ring pedestal having the same diameter as that of the lower lip packing and the mounts mounting and fixing the casing at the bottom of the outer case.

4. The lever switch according to claim 1, further comprising a cover for covering a common fixed terminal, a pair of side fixed terminals and lead wires, the common fixed terminal being connected to the common fixed contact, the pair of side fixed terminals being connected to the side fixed contacts, the common and side terminals protruding outward from the base, and lead wires being welded respectively to the common fixed terminal and the side fixed terminals.

5. The lever switch according to claim 1, wherein the casing, upper lip packing and lower lip packing are formed in a single piece made of elastomer.

* * * * *